United States Patent [19]

Bostrom

[11] Patent Number: 4,797,597

[45] Date of Patent: Jan. 10, 1989

[54] MICROWAVE ION SOURCE

[76] Inventor: Norman A. Bostrom, Rte. 2, Box 157-D, Georgetown, Tex. 78626

[21] Appl. No.: 944,026

[22] Filed: Dec. 22, 1986

[51] Int. Cl.[4] ..... H01J 27/00

[52] U.S. Cl. ..... 315/39; 315/111.81; 250/423 R; 313/230; 313/231.31; 313/156; 313/161; 313/359.1

[58] Field of Search ..... 313/156, 161, 230, 231.31, 313/359.1; 315/111.81, 39; 250/423 R; 333/35

[56] References Cited

U.S. PATENT DOCUMENTS

| | | | |
|---|---|---|---|
| 3,364,383 | 1/1968 | Cooper | 333/35 |
| 3,495,125 | 2/1970 | Koontz | 333/35 X |
| 3,593,224 | 7/1971 | Eggers et al. | 333/35 X |
| 4,041,420 | 8/1977 | Riblet | 333/35 |
| 4,058,748 | 11/1977 | Sakudo et al. | 313/156 |
| 4,316,090 | 2/1982 | Sakudo et al. | 250/423 R |
| 4,393,333 | 7/1983 | Sakudo et al. | 315/111.81 |
| 4,658,143 | 4/1987 | Tokiguchi et al. | 250/423 R |

*Primary Examiner*—David K. Moore
*Assistant Examiner*—Mark R. Powell
*Attorney, Agent, or Firm*—Robert F. O'Connell

[57] ABSTRACT

A microwave ion source is disclosed and includes a plain rectangular waveguide having a first section to which a microwave generator is coupled, a second section defining a discharge chamber and an intervening transformer section dimensioned to provide for transmission of microwaves between the first section and the second section substantially without impedance losses. The first and second sections have uniform rectangular internal cross-sectional shapes defined by a first dimension which, for both sections equals one half of the wavelength of the microwaves, and a second, smaller dimension which is less than the second section of the waveguide than in the first section.

20 Claims, 6 Drawing Sheets

MICROWAVE ION SOURCE

FIELD OF THE INVENTION

This invention relates generally to ion sources; that is, devices in which a feed material (usually a gas) is ionized by forming a plasma, from which an ion beam can be extracted. More particularly, the invention is concerned with so-called "microwave ion sources" in which the plasma is formed by microwave discharge in a magnetic field.

BACKGROUND OF THE INVENTION

Ion sources are used commercially in equipment for implanting selected ions in materials such as semi-conductor wafers in the manufacture of electronics components. Proposals have also been made to use ion implantation for changing the physical properties of materials. For example, it has been found possible to improve properties such as corrosion and wear resistance and to change the frictional charcteristics of metals by ion implantation.

In a typical commercial ion implanter, an ion beam is extracted from the plasma and is refined (classified) and accelerated towards a target material into which ions are to be implanted. The ion source should preferably have a long life and be capable of producing a high, stable current output. A well defined and stable beam is also desirable.

DESCRIPTION OF THE PRIOR ART

Prior art ion sources in commercial use have commonly used a hot cathode to produce electrons required in the ionization process. These hot cathode sources produce a stable current over a relatively long life time at low outputs of about 1 mA. At higher outputs of about 10 mA, however, these sources are subject to high frequency perturbations or "hash" in the ion beam thus reducing the uniformity of ion implantation and leading to rapid filament burn-out with consequently reduced source life time.

Microwave ion sources have been found to exhibit certain advantages over the hot cathode ion source. The use of microwave energy to form the plasma avoids the need for a cathode; consequently the life of the source is not dependant on a consumable component. Microwave ion sources have also been found to produce less "hash" at high ion densities. Lower feed gas pressures are also possible, which results in less contamination of the plasma chamber and conservation of the feed material. Also, commercially available microwave generators of the type that have been extensively developed for microwave ovens can be used to provide the required microwave discharge.

United States patent literature discloses several examples of microwave ion beam sources, including the following patents: Nos.

3,476,968 (Omura)
3,778,656 (Fremiot et al.)
4,058,748 (Sakuda et al.)
4,316,090 (Sakuda et al.)
4,393,333 (Saduda et al.)
4,409,520 (Koike et al.)

Both Fremiot et al. and Omura disclose use of a resonant chamber for propagating microwaves in the formation of a plasma. However, this approach has certain disadvantages (see U.S. Pat. No. 4,058,748, at column 3, line 22 to column 4, line 43 inclusive).

The U.S. patents to Sakuda et al. and Koike et al. each disclose the use of a ridged microwave generator to a discharge chamber in which the plasma is to be formed. These patents are discussed later for better understanding of the present invention.

Ridged waveguides are said to produce good microwave uniformity in the discharge chamber. However, it has been found that the presence of ridges in the waveguide makes construction of the waveguide difficult. Problems also arise in propogating microwave energy into the discharge chamber due to the fact that the chamber must be sealed from the waveguide and maintained under vacuum. The sharp edges within the waveguide cause spurious discharges and consequent instability of the generated plasma, as well as unreliable on-off characteristics. Using a ridged waveguide also requires large, awkward coils for producing the magnetic field in the discharge chamber. This is because the ridges create a physical barrier between the discharge chamber and the coils, which forces the coils away from the discharge chamber and thus requires that the coils be fairly large to create the required intense magnetic field. Using large coils also requires a higher power input.

U.S. Pat. No. 4,316,090 (Sakuda et al.) discloses a proposal said to avoid the need for large coils. However, it appears that relatively large coils would still be required, along with a relatively complex waveguide and a magnetic permeable member located adjacent to the waveguide and discharge chamber to shape the magnetic field.

U.S. Pat. No. 4,409,520 (Koike et al.) attempts to overcome the problem of coupling microwave energy from the waveguide into the discharge chamber through a vacuum seal but still requires a tapered ridge to guide the microwaves into the discharge chamber. This ridge is not only difficult to construct but the taper is a relatively inefficient means of coupling microwave energy into the discharge chamber, and requires a large volume of dielectric material to fill the waveguide in the discharge portion of the waveguide between the vacuum seal and the discharge chamber itself. The ridges in the waveguide also require the use of the large coils to create the required magnetic field since the ridges are a physical barrier between the coils and the discharge chamber.

An object of the present invention is to provide an improved microwave ion source which offers advantages over the prior art.

BRIEF DESCRIPTION OF THE INVENTION

The ion source provided by the invention includes a microwave generator and a waveguide having a first section to which the microwave generator is coupled for generating microwave radiation in the waveguide, a second section downstream of the first section in the direction microwave propagation along the waveguide, and in which a discharge chamber is defined, and a transformer section between the first and second sections. Each of the first and second sections has a uniform rectangular internal cross-sectional shape throughout the length of the section. Preferably, each shape has a first dimension which is equal for both sections and is selected to at least approximate one-half of the nominal wavelength of the microwaves produced at the rated operating frequency of the generator, and a lesser, second dimension which is smaller in the second section of the waveguide than in the first section. The transformer section is dimensioned to provide for transmission of microwaves from the first section to the second section substantially without impedance losses. Means is provided between the first and second waveguide sections for providing a vacuum seal without impeding propagation of microwaves along the waveguide. A liner of dielectric material forms the discharge chamber within the second waveguide section. The ion source also includes means for generating a magnetic field in the discharge chamber, means for maintaining a vacuum in the chamber, means for introducing a feed material into the chamber for forming a plasma and means for extracting an ion beam from the chamber.

In practice, it has been found possible to achieve a stable, reliable ion beam capable of providing a high stable current output using an ion source of the form provided by the invention. Long source life has also been achieved.

Preferably, the beam extraction means includes a rectangular slit through which the mean is extracted from the discharge chamber and which is aligned with the rectangular section of the waveguide.

BRIEF DESCRIPTION OF THE DRAWINGS

Reference will now be made to the accompanying drawings which illustrate a preferred embodiment of the invention by way of example, and in which.

DESCRIPTION OF THE PREFERRED EMBODIMENT

Figure 1:
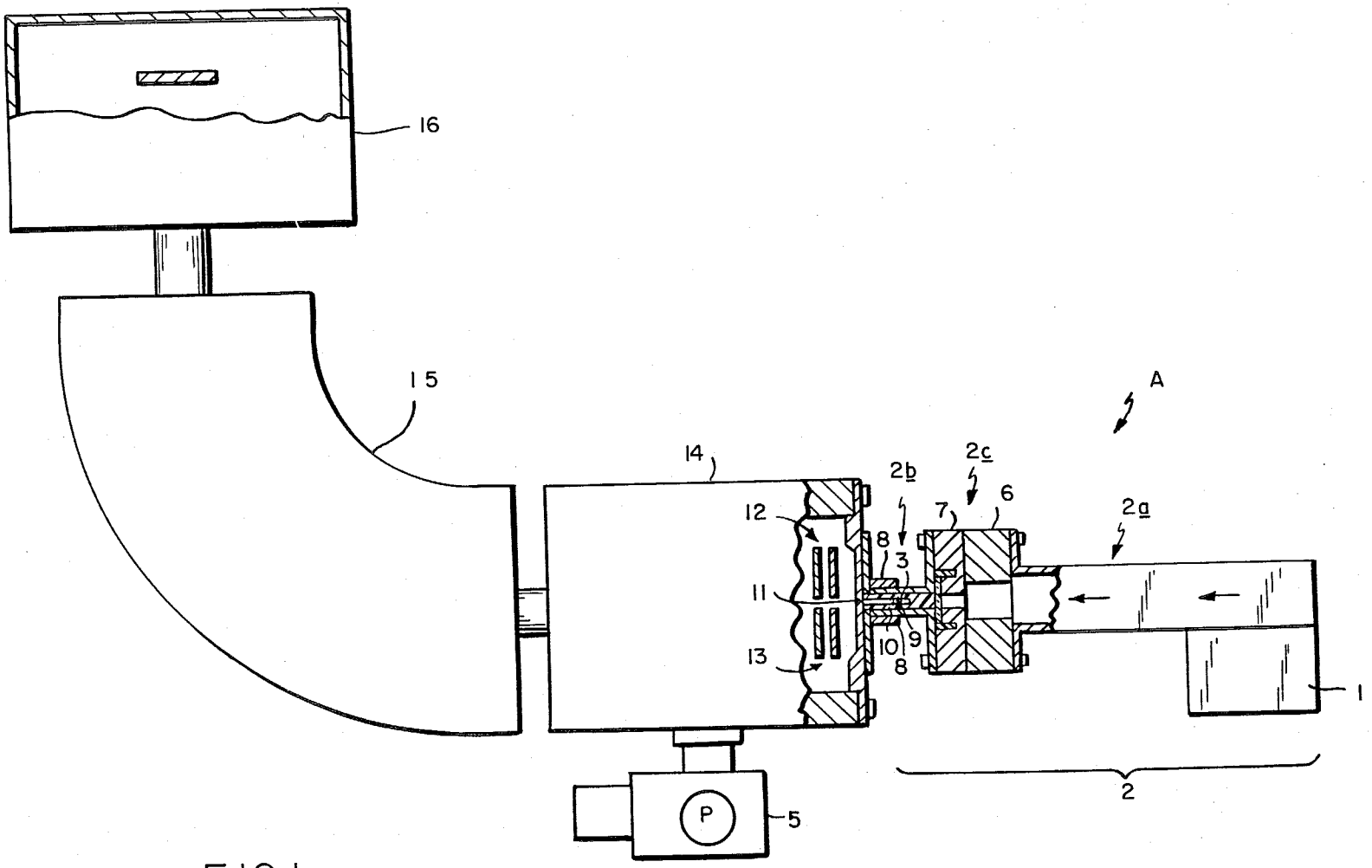
FIG. 1 is a schematic layout of an ion implanter incorporating an ion course of the form provided by the invention.

Referring first to FIG. 1, a microwave generator 1 is shown connected to a waveguide 2 which includes a discharge chamber 3. Waveguide 2 includes a first section **2*a* to which the generator 1 is coupled, a second section 2*b* which houses the discharge chamber 3, and an intermediate transformer section 2*c*. Section 2*b* is maintained at a low pressure by a vacuum pump 5. Microwaves propagate along the waveguide 2 in the direction indicated by the arrows in FIG. 1 and are concentrated in section 2*b* after passing through a transformer 6 forming waveguide section 2*c*, and a choke 7. A magnetic field is generated in the discharge chamber 3 by magnets generally denoted 8. Feed material is introduced into the discharge chamber 3 through a gas inlet 9. Interaction of the feed material, microwave field and magnetic field creates a plasma in section 2*b* of the waveguide 2. The plasma is confined within the discharge chamber 3 by a liner 10** of dielectric material.

An ion beam generated by the ion source is extracted through an extraction slit 11 by extraction electrodes 12 and 13. The ion beam is then accelerated in a convention acceleration chamber 14, refined by a conventional particle classifier 15 and directed onto a target in a target chamber 16.

Figure 2:
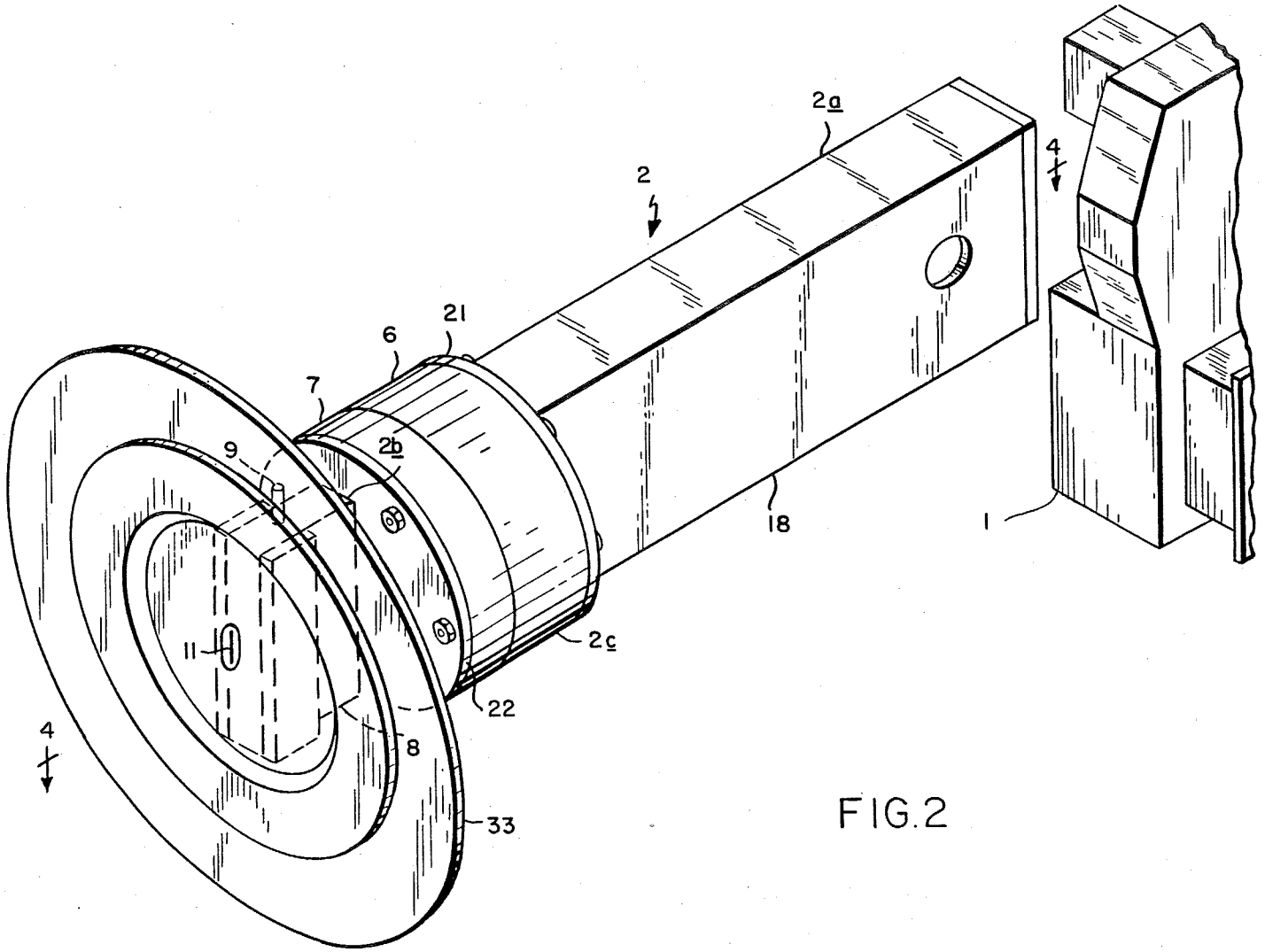
FIG. 2 is a prespective view generally in the direction of arrow "A" in FIG. 1.

The microwave generator 1 is connected to the waveguide 2 at an appropriate distance from the end of the waveguide so that the microwave energy reflecting from the end of the waveguide adds to the waves propagating directly from the microwave source away from the end of the waveguide. The microwave generator 1 may be of the type used in a commercial microwave oven and, for example, generates a microwave frequency of 2.45 GHz using 600 watts power. If a microwave generator of the type used in a microwave oven is used then the generator may be connected to the waveguide simply by inserting the antenna or probe of the generator into an opening in one of the sides of the waveguide as best seen in FIG. 2.

The waveguide 2 must be large enough to avoid unnecessary ionization of air molecules by the microwave electric field in the region of the waveguide near the microwave source. Such ionization would interfere with the propagation of microwaves. The waveguide 2 must also be long enough to avoid interference from the intense magnetic fields at the discharge section **2*b* of the waveguide 2. The waveguide 2**, however, need not necessarily be straight but may be curved or kinked in accordance with known waveguide theory.

The waveguide 2 may be made of any good conducting material, but in the example shown has been constructed from aluminum. A rectangular waveguide has been found to propagate microwaves well and to be easy to construct. A rectangular waveguide is free of interior sharp edges and therefore avoids spurious microwave discharges which interfere with the operation of the source. To propagate microwaves in the waveguide, one dimension of the waveguide cross-section must be at least half $\lambda$w-g where $\lambda$w-g is the wave length of the microwave in the waveguide. In the case of microwaves having a frequency of 2.45 GHz propagating in a rectangular aluminum waveguide, a half $\lambda$w-g is approximately 3.4 inches. In the preferred embodiment, the height h (FIG. 3) of waveguide is taken to be exactly a half $\lambda$w-g, in which case only the $E_{10}$ microwave propagates along the waveguide in accordance with known electromagnetic wave theory. Dimension h is uniform throughout the length of the waveguide.

The other dimension (width) of the waveguide is not critical but, as discussed above, must be wide enough to avoid excessive ionization of air molecules. The width of the waveguide must also be less than the height so that only the $E_{10}$ microwave propagates along the waveguide. It would therefore be a relatively simple matter to change the size of the microwave ion source by using microwave sources with different frequencies. Thus, if microwaves with a frequency of 10 GHz were used, a waveguide of height 1.8 inches would propagate the microwaves.

In accordance with electromagnetic waveguide terminology, if a waveguide is constructed with one dimension of its cross-section equal to $\frac{1}{2}\lambda$w-g and with the other dimension of cross-section less than $\frac{1}{2}\lambda$w-g then the sides with length $\frac{1}{2}\lambda$w-g will be the electrodes of the waveguide and the E field will be perpendicular to them, creating a voltage differential V between the two electrodes at the centre of the waveguide which diminishes to zero at the top and bottom of the electrodes. The magnitude of the $E_{10}$ field at the centre will then be $V/b_1$ where $b_1$ is the width of the waveguide. Thus, in the drawings, the electrodes are the vertical sides of the waveguide as indicated by reference numeral 17 (FIG. 4) in the discharge section 2b of the waveguide, and 18 in the case of section 2a.

It is essential that the distance between the electrodes 17 be smaller than the distance between the electrodes 18 to ensure that the microwave field has sufficient strength to create a high density plasma. In the preferred embodiment, the distance between the electrodes 17 is 0.315 inches. The magnitude of the E field in the discharge section 2b of the waveguide 2 will then be equal to the magnitude of the E field in waveguide section 2a times the ratio of the distance between the electrodes 18 to the distance between the electrodes 17.

Thus, in the preferred embodiment the intensity of the microwave electric field in the discharge section 2b of the waveguide 2 increases by a factor of 1.7/0.315 or more than 5 times compared with the intensity in the waveguide near the microwave generator. This increase in the magnitude of the E field allows a high ion density plasma to be generated in the discharge portion of the wave guide with low input power.

Figure 4:
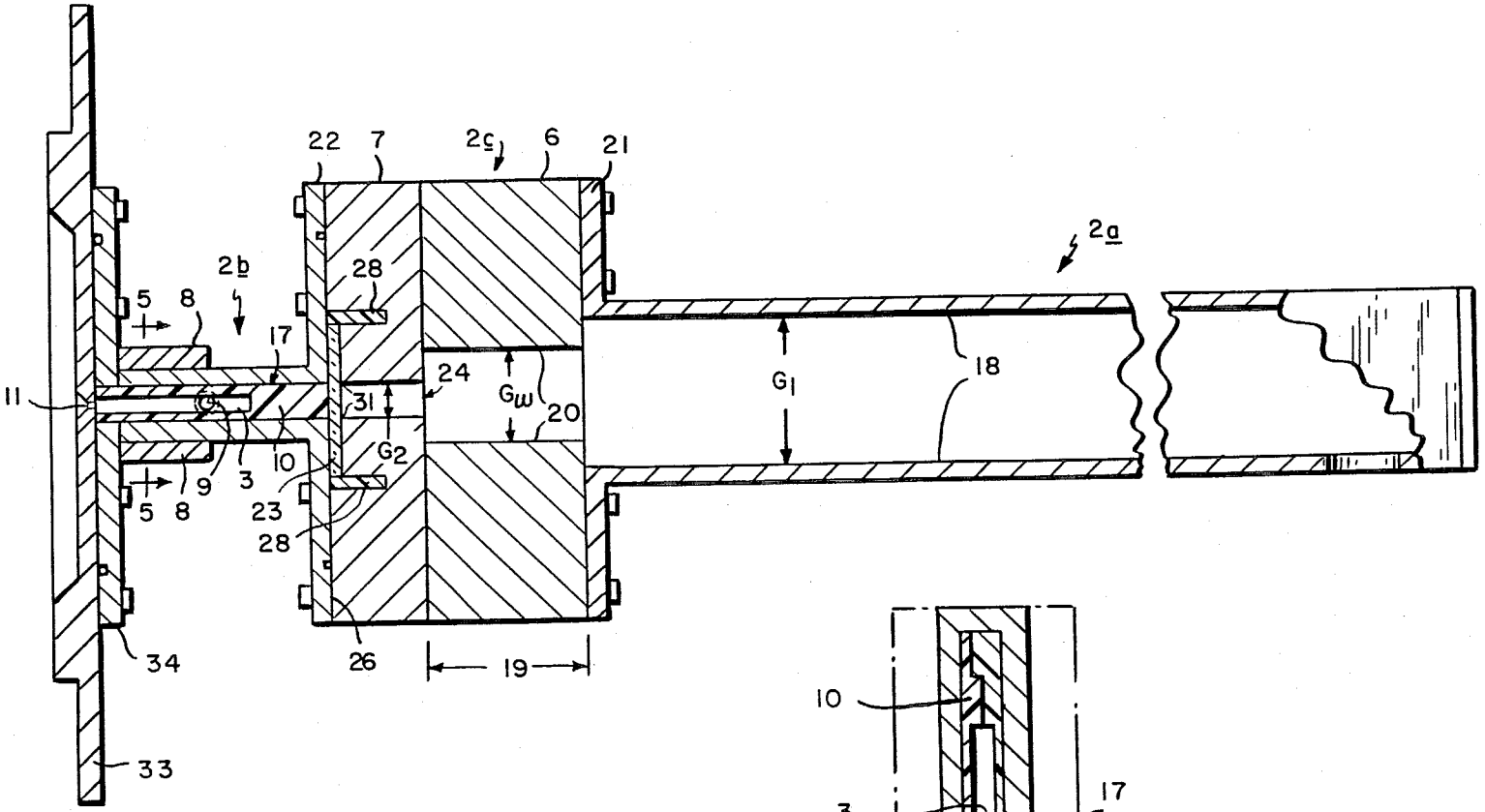
FIG. 4 is a horizontal cross-sectional view taken on line 4—4 in FIG. 2.

A quarter wave-length transformer 6 is used to transmit the microwave energy from waveguide section 2a to the discharge section 2c of the waveguide. The transformer 6 will transmit 100% of the microwave energy between the waveguides if it is constructed as follows:

Referring now to FIG. 4, the length 19 of the transformer section 2c of the waveguide is equal to $\frac{1}{4}\lambda w\text{-}g$. The distance between the electrodes 20 of the transformer section 2c is related to the distance between the electrodes of the remainder of the waveguide as follows:

$$b_w=\sqrt{b_1 b_2},$$

where $b_w$ is the distance between the electrodes 20 of the transformer, $b_1$ is the distance between the electrodes 18 of the waveguide section 2a, and $b_2$ is the distance between the electrodes 17 in the discharge section 2b of the waveguide. By using this transformer configuration, it has been found that 100% of the microwave energy is transmitted between the portions of the waveguide having different widths, so long as only the $E_{10}$ microwave propagate along the waveguide.

It is to be noted that a series of such transformers would work equally well, whether they be located immediately adjacent each other or spaced apart along the waveguide 2.

In the drawings, the transformer 6 is shown as circular and in the form of a metal block. However, this construction is a matter of convenience only, since the essential part of the transformer is the interior conducting surface. Hence, the transformer could equally be made of sheet aluminum with flanges at its ends for connection to adjacent components, such as the flange 21 at the end of waveguide section 2a.

Figure 3:
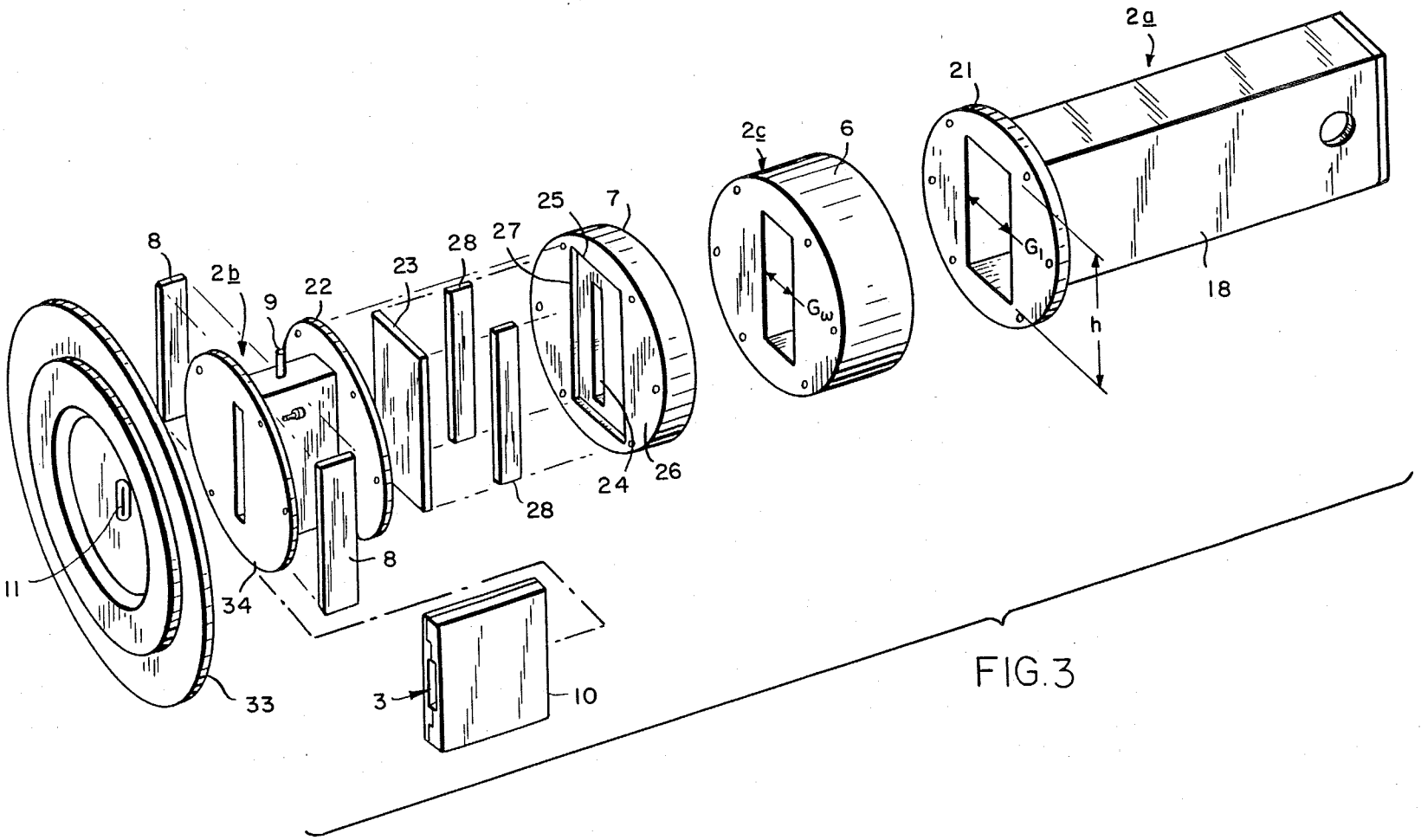
FIG. 3 is a view similar to FIG. 2, showing the ion source exploded to illustrate its construction.
Figure 6:
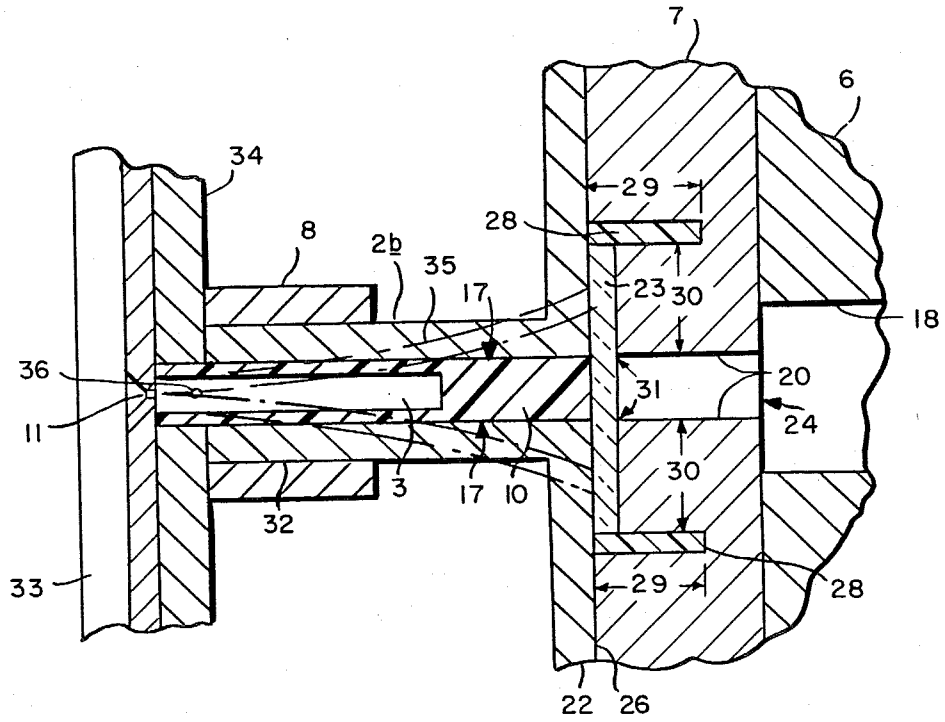
FIG. 6 is an enlarged view of part of FIG. 4.

The discharge portion of any microwave ion source must be maintained at low pressure to avoid contamination of the plasma with unwanted ions. It is clear that the waveguide may be vacuum sealed all the way back to the microwave ion source 1. However, if such a large volume is to be maintained at a low pressure, a comparatively large vacuum pump is required. Referring now to FIGS. 3 and 6, it will be seen that the choke 7 is of essentially similar form to transformer 6 and is placed between the transformer 6 and discharge section 2b of the waveguide 2 and effectively forms part of that section. Choke 7 provides a vacuum seal in section 2b by incorporating a quartz panel or window 23. Window 23 allows propagation of microwaves without transmission losses. It may of course be made of any dielectric material instead of quartz, with suitable changes in dimensions.

As best seen in FIG. 6, choke 7 has a rectangular recess 25 for receiving the quartz window 23; the recess is dimensionsed so that the outer face of the window 23 lies flush with the surface 26 of the choke 7. Choke 7 also has slots 27 at right angles to recess 25 for receiving rectangular quartz plates 28 which extend perpendicular to the quartz window 23 and in effect form side flanges of the windows in the assembled waveguide. The quartz window 23 and quartz flanges 28 are designed so that lengths 29 and 30 (FIG. 6) are each $\frac{1}{4}\lambda w\text{-}g$. Since a standing wave is formed in slots 27 by this design, no current flows at corners 31; hence there is no impedence to the microwave propagation across the choke 7 into the discharge section 2b of the waveguide.

As discussed previously, the discharge section 2b has a rectangular cross-section with one dimension $\frac{1}{2}\lambda w\text{-}g$ and other dimension 0.315 inches, and is made of aluminum. This portion of the waveguide may be made as long as is convenient, but should be sufficiently long to allow placement of the magnets 8 closely adjacent the sides of the waveguide. As noted above, the waveguide may be made of any good conductor (e.g. copper) but aluminum is chosen for convenience.

Both waveguide sections 2a and 2b are fabricated from sheet aluminum and have rectangular box-shaped centre portions. In the case of section 2a, one end of the centre portion is closed by an end plate while the other end is fitted with flange 21. The centre portion of section 2b has flanges 22, 34 at both ends. The flanges are of circular shapes selected to match the circular shapes of transformer 6 and choke 7. The assembly forming the waveguide is held together by bolts through the flanges as best seen in FIG. 4.

It is evident that the vacuum sealing choke 7 may be located anywhere between discharge chamber 3 and transformer 6, but is located adjacent transformer 6 for convenience of construction.

Gas inlet 9 permits introduction of feed material into the discharge section 2b of the waveguide 2. In the preferred embodiment illustrated, gas inlet 9 takes the form of a needle valve. A liner 10 of dielectric material 10 fits loosely inside the discharge section of the waveguide and is formed with a recess which defines the discharge chamber 3. In this embodiment the dielectric material is of boron nitride. As best seen in FIG. 4, inlet 9 is located so that feed material can be delivered directly into the discharge chamber 3.

Figure 5:
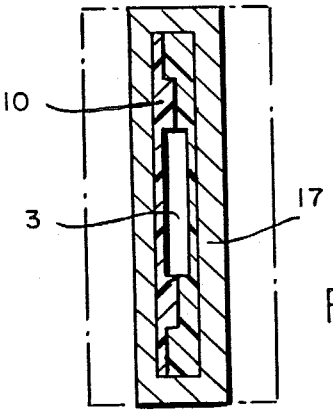
FIG. 5 is a vertical cross-sectional view taken on line 5—5 in FIG. 4.

Discharge chamber 3 has a rectangular shape in cross-section, which is desirable for extracting ribbon-shaped ion beams. In this preferred embodiment, the dimensions of the discharge chamber are 1.50 inches×1.50 inches ×0.20 inches. To help prevent contamination of the aluminum waveguide by ions straying from the plasma, the dielectric insert 10 is constructed in two halves as shown in FIG. 5, with the plane of bisection between the two halves vertical and parallel to the direction of the propagation of microwaves. The abutting faces of the two halves are stepped as shown to provide impedance to stray ions.

Insert 10 protects the electrodes 17 of the discharge section 2b of the waveguide from being bombarded with ions and electrons in the plasma formed in the discharge chamber 3. The dielectric material also confines the plasma to the small volume of the discharge chamber 3. In the discharge chamber 3, the microwave electric field established between the electrodes of the discharge section 2b of the waveguide 2 is relatively uniform and therefore provides a relatively uniform plasma. As discussed above, the concentration of microwave electric energy between the narrow electrodes 17 provides sufficient energy to create a high ion density plasma from a feed material introduced through gas inlet 9. Insert 10 also reduces the volume which must be maintained at a low pressure.

An end plate 33 is connected to flange 34 at the outer end of waveguide section 2b (FIG. 2). An extraction slit 11 is provided in plate 33. The extraction slit has a rectangular shape and is oriented with its edges parallel to the walls of discharge chamber 3. The edges of the extraction slit 11 are cut at an angle of 128° to the outer face of the plate 33 in the preferred embodiment (FIG. 6), although the exact angle is not critical. Plate 33 is made from a good conducting material such as mild steel and acts as an extraction electrode. Like the rest of the ion source assembly it is maintained at a high electrical potential. Plate 33 fits vacuum tightly with the end of acceleration chamber 14.

The extraction slit has dimensions of 0.75 inches ×0.0312 inches, and depth approximately 0.020 inches so that a stable ion beam may be extracted from the plasma generated in the discharge chamber 3, as is known in the art. Referring to FIG. 1, extraction electrode 12 is negatively charged with respect to discharge chamber 3 while extraction electrode 13 is grounded. The two electrodes are placed adjacent the extraction slit 11 to extract positive ions from the plasma generated in the discharge chamber 3. The extracted ions are then accelerated through a known acceleration chamber 14, through known particle analyzer 15 towards a known target chamber 16.

Vacuum pump 5 is connected to the acceleration chamber 14 and evacuates the discharge section 2b of the waveguide through the slit 11. As is known, evacuation of a relatively large volume through a slit is inefficient; hence it is necessary to keep the discharge section 2b of the waveguide as small as may be allowed by the requirement of allowing the magnets 8 to be placed close to the discharge chamber 3.

The magnets 8 are placed adjacent the discharge section 2b of the waveguide so that the magnetic field lines indicated at 35 are FIG. 6, are perpendicular to the microwave electric field. As is known in the art, a non-uniform magnetic field in the discharge chamber of an ion source allows the efficient absorption of microwave energy by the plasma. In this embodiment, the magnetic field generated by the magnets 8 must have an intensity greater than 890 gauss, being the electron cyclotron resonant field for a 2.45 $GH_z$ electromagnetic field. The magnetic field required for a miniaturized source, in which the frequency of the microwave field was higher, would have to have higher strength in accordance with known electromagnetic theory. The field thus produced causes the electrons in the plasma to spiral along the magnetic field lines and this reduces the number of collisions of the electrons with the walls of the discharge chamber 3, besides increasing the density of the plasma. In this manner the dielectric insert 10 will last longer, as is well known.

The absence of prior art ridged electrodes surrounding the discharge chamber permits the magnets 8 to be placed closely adjacent the discharge section of the waveguide and thus in close proximity to the discharge chamber 3. This allows the magnets 8 to have relatively low magnetic strength; unlike prior art ion sources, large magnets need not be used.

Permanent magnets or electro-magnets may be used. In either case, the magnets can easily fit between the flanges 34 and 22 of the discharge section 2b of the waveguide 2 as shown in FIG. 4.

Magnets 8 are floated at the same potential as the ion source assembly so as to avoid spurious discharges between the magnets and the waveguide.

FIG. 6 illustrates a further, but optional feature of the invention. A charged rod or wire 36 may be inserted through the discharge chamber to intensify the plasma near the extraction slit. The rod 36 is located a few millimeters behind and parallel to the slit 11. The rod 36 creates a strong magnetic field near the extraction slit which intensifies and homogenizes the plasma by confining the electrons in that region.

The rod 36 also creates a physical barrier to neutral ions migrating towards the extraction slit and therefore improves the vacuum in the vicinity of the slit. The improvement in vacuum also aids in avoiding breakdown of the plasma near the extraction slit where voltages are high (in the order of 80,00 volts near the gap).

The charged rod 36 must be oriented parallel to the length of the slit; that is, perpendicular to the microwave electric field, otherwise the field of the wire will interfere with the microwave electric field thereby reducing the uniformity of the electric field and thus reducing the uniformity of the plasma.

A charged helical wire may be used in place of rod 36.

An ion beam of current density 0.1 in $A/m^2$ has been obtained from the ion source as described using permanent magnets and using 200 watts power. Power consumption may rise to 1800 watts if magnetic coils are used.

Figure 7:
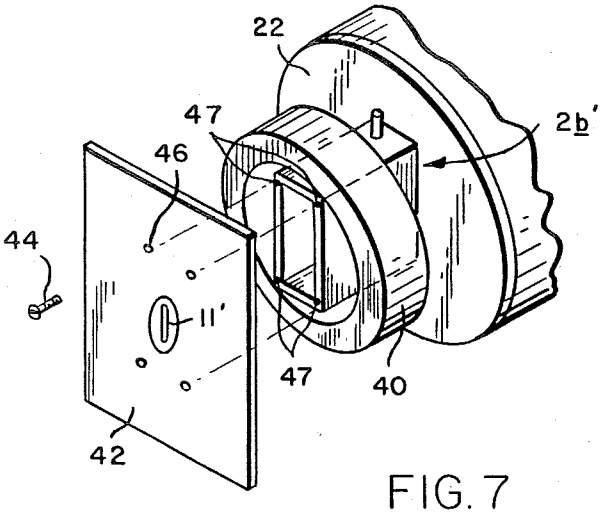
FIG. 7 is a detail view of an alternative embodiment of the invention and is similar to part of FIG. 3.
Figure 9:
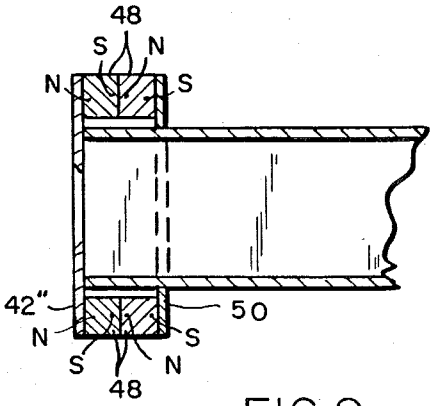
Figure 8:
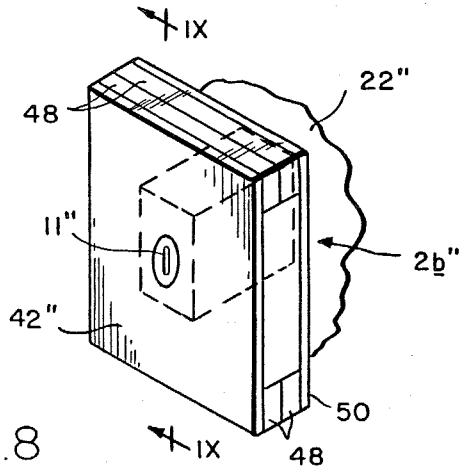
FIG. 8 is a view similar to FIG. 7 showing a still further alternative embodiment; and, FIG. 9 is a vertical sectional view on line IX—IX of FIG. 8.

Reference will now be made to FIGS. 7 to 9 in describing further embodiments of the invention. Primed reference numerals have been used in FIG. 7 to denote parts corresponding with parts shown in the previous views and double primed reference numerals have similarly been used in FIG. 8 and 9.

FIG. 7 is similar to the lefthand end part of FIG. 3 but showing an embodiment of the invention in which the flange 34 (FIG. 3) at the outer end of the discharge section of the waveguide is omitted and the end plate in which the extraction slit 11 is formed is attached directly to the open outer end of the waveguide; also, the two bar magnets 8 shown in FIG. 3 are replaced by a single large annular magnet that encircles the discharge portion of the waveguide. In FIG. 7, this magnet is denoted by reference numeral 40 while the discharge section of the waveguide is denoted 2b'. The annular magnet itself is a commercially available magnet. In some cases, it may be desirable to use a magnet of this form because it is generally easier to obtain the relatively high magnetic field strength required within the discharge section 2b than with bar magnets.

The end plate in which the extraction slit 11' is formed in this case takes the form of a rectangular steel plate 42 that is secured directly to the open outer end of the waveguide section 2b' by screws, one of which is indicated at 44, extending through openings 46 in plate 42 and received in tapped holes in the outer end face of the waveguide discharge section 2b'. Those holes are indicated at 47. This form of end plate and its method of attachment to the waveguide represent a simplification in manufacture as compared with the preceding embodiment.

FIGS. 8 and 9 show a further alternative embodiment in which rare earth bar magnets are used. The magnets may, for example, be europium/cobalt magnets available from commercial sources. These magnets provide high field strengths and it has been found possible to construct an ion source of reduced size and weight using magnets of this type as compared with the preceding embodiments.

As seen in FIGS. 8 and 9, the waveguide discharge section 2b'' is essentially the same as previously described and is fitted with an end plate 42'' which is generally the same as the end plate 42 of FIG. 7. Four rare earth bar magnets, individually denoted 48, are placed in pairs above and below the waveguide discharge section 2b'' with faces of opposing polarity in contact as shown in FIG. 9. The magnets are in effect clamped against the end plate 42'' by a clamp plate 50 that embraces the waveguide discharge section rearwardly of the end plate. Plate 50 effectively has a central rectangular opening through which the waveguide extends but in practice may be formed into pieces, for example, as a generally C-shaped piece that will fit against one side of the waveguide and the limbs of which will extend above and below the waveguide, and a bar disposed at the opposite side of the waveguide and secured to the outer ends of the limbs of the other part of the plate by bolts. Plate 50 may be frictionally clamped about the discharge section 2b'' of the waveguide or may be secured to the end plate 42' by bolts either extending through the magnets or disposed just outwardly of the magnets (in which case the magnets will have to be somewhat shorter than the overall width of the plates). Alternatively, adhesives may be used to secure together the "sandwich" comprising the two plates and the four magnets.

In operation, the magnets form a magnetic circuit through the two plates 42' and 50. The fact that plate 50 in effect has a central opening where the waveguide extends through the plate creates the required non-uniformity in the field.

In a practical experiment, it was possible to generate a field strength within the discharge chamber exceeding 890 gauss using a configuration of the form shown in FIGS. 8 and 9.

It will of course be understood that the preceding description relates to a particular preferred embodiment and that many modifications are possible within the broad scope of the invention. For example, the particular materials referred to previously may of course vary. In addition, certain of the dimensions of the waveguide may also change, and may particularly change in accordance with frequency of microwave generator used. Similarly, while certain dimensions of the interior of the waveguide are critical, such as at the microwave transformer, the exterior shape is largely a matter of choice. Furthermore, the actual voltages and power used may be varied depending on the desired nature of the ion beam. Various gases or vapours may be used in the ion source according to the form of ion beam required.

I claim:

1. A microwave ion source comprising:

a microwave generator;

a waveguide comprising a first section to which said microwave generator is coupled for generating microwave radiation in said waveguide, a second section downstream of the first section in the direction of microwave propagation along the waveguide, and in which a discharge chamber is defined, and a transformer section beteween said first and second sections, said first and second sections having uniform rectangular internal cross-sectional shapes throughout the lengths of the respective sections, defined by a first dimension which is equal for both sections and is selected to at least approximate one half of the nominal wavelength of the microwaves produced at the rated operating frequency of the generator, and a lesser, second dimension which is smaller in said second section of the waveguide than in said first section, said transformer section being dimensioned to provide for transmission of microwaves from said first section to said second section substantially without impedance losses;

said transformer section including means between said first and second waveguide sections for providing a vacuum seal without impeding propagation of microwaves along the waveguide;

a liner of dielectric material within said second waveguide section defining said discharge chamber;

means for generating a magnetic field in the discharge chamber;

means for producing a vacuum in said chamber;

means for introducing a gaseous feed material into said chamber for forming a plasma; and, means for extracting an ion beam from said chamber.

2. An ion source as claimed in claim 1, wherein the magnetic field generating means comprise a pair of magnets disposed in abutment with opposite walls of said second section of the waveguide which form the electrodes of the waveguide section, said magnets being located adjacent the discharge chamber.

3. An ion source as claimed in claim 1, further comprising a charged rod or wire disposed in said discharge chamber and oriented perpendicular to the microwave electric field in said chamber.

4. An ion source as claimed in claim 1, wherein said means providing a vacuum seal comprises a choke downstream of the transformer section of the waveguide in the direction of microwave propagation along the waveguide, the choke including a quartz window extending across the waveguide for providing said vacuum seal without impeding propagation of microwaves along the waveguide.

5. An ion source as claimed in claim 4, wherein said transformer comprises a block of aluminum disposed immediately adjacent said transformer section of the waveguide with said quartz window disposed at a face of said block remote from the transformer section, the block including a passageway extending from said window and communicating with said transformer section forming a continuation of said discharge section of the waveguide upstream of said quartz window in the direction of microwave propagation.

6. An ion source as claimed in claim 5, wherein walls of the waveguide defining said first dimension of each of said first and second waveguide sections form electrodes of the waveguide, and wherein said window extends beyond said passageway outwardly of the electrodes of the discharge section of the waveguide by a distance equal to one quarter of the nominal wavelength of the microwaves produced by said microwave generator at the rated operating frequency of the generator, said window being of rectangular shape, and wherein the choke further includes flanges extending generally at right angles to said window into the aluminum block from outer edges of said window which are parallel to said electrodes, each said flange being of a length extending into the block equal to said one quarter waveguide dimension of the window.

7. An ion source as claimed in claim 1, wherein said transformer section comprises a block of aluminum disposed between said first and second waveguide sections and having therein a passageway dimensioned to provide for said transmission of microwaves from said first section to said second section substantially without impedance losses.

8. An ion source as claimed in claim 1, wherein said transformer section is of a length in the direction of microwave propagation along the waveguide equal to one quarter of the nominal wavelength of the microwave produced at the rated operating frequency of the generator.

9. An ion source as claimed in claim 1, wherein said first and second waveguide sections and said transformer section each have opposite walls having said first dimension selected to at least approximate one half of the nominal wavelength of the microwaves produced at the rated operating frequency of the generator, the respective walls of each section forming electrodes of the waveguide, wherein the distance between the electrodes in the respective sections is defined by the following relationship:

$$b_w=\sqrt{b_1 b_2},$$

wherein bw is the distance between the electrodes in the transformer section, $b_1$ is the distance between the electrodes in the first waveguide section and $b_2$ is the distance between the electrodes in the second waveguide section.

10. An ion source as claimed in claim 8, in which the rated operating frequency of the microwave generator is 2.45 GHz and the distance between the electrodes in the second section of the waveguide is 0.315 inches.

11. An ion source as claimed in claim 4, wherein each of said choke and transformer comprises an aluminum block of constant thickness in the direction of microwave propagation along the waveguide, and wherein each of said first waveguide section and the portion of said second waveguide section defining said discharge chamber comprises a fabrication from sheet aluminum including a rectangular box-shaped centre portion having flanges at its ends, said fabrications and blocks being coupled together end-to-end to form said waveguide.

12. An ion source as claimed in claim 11, wherein said means for generating a magnetic field comprise a pair of magnets disposed in contact with walls of said waveguide defining opposite sides of said rectangular box-shaped centre section of the waveguide defining said first dimension selected to approximate one half of the the nominal wavelength of the microwaves at the rated operating frequency of the generator, said magnets being arranged to produce a non-uniform magnetic field in said discharge chamber.

13. An ion source as claimed in claim 9, further comprising a plate connected to the flange of said discharge section at the outer end of the waveguide, said plate being formed with a slit defining an ion beam extraction slit of the source.

14. An ion source as claimed in claim 13, wherein said extraction slit is disposed with its edges parallel to the walls of the discharge chamber and is formed with said walls disposed at angles of approximately 128° to the outer face of the plate.

15. An ion source as claimed in claim 14, wherein said extraction slit has dimensions of 0.75 inches×0.0312 inches and a depth of approximately 0.020 inches.

16. An ion source as claimed in claim 1, wherein said microwave generator has a rated operating frequency of 2.45 GHz.

17. An ion source as claimed in claim 1, wherein said liner defining a discharge chamber is made of boron nitride.

18. An ion source as claimed in claim 1, wherein said means for generating a magnetic field in the discharge chamber comprises an annular magnet encircling said discharge chamber.

19. An ion source as claimed in claim 1, wherein said means for generating a magnetic field in the discharge chamber comprise rare earth magnets disposed adjacent opposite walls of said second section of the waveguide between an end plate at an outer end of the waveguide in which an ion beam extraction slit is defined, and a plate which extends around said second section of the waveguide and which is similar to said end plate but formed with an opening through which the waveguide extends, whereby said plates and magnets form a magnetic circuit.

20. A microwave ion source comprising:

a microwave generator;

a waveguide comprising a first section to which said microwave generator is coupled for generating microwave radiation in said waveguide, a second section downstream of the first section in the direction of microwave propagation along the waveguide, and in which a discharge chamber is defined, and a transformer section between said first and second sections, said first and second sections having uniform rectangular internal cross-sectional shapes throughout the lengths of the respective sections, said transformer section being dimensioned to provide for transmission of microwaves from said first section to said second section substantially without impedance losses;

means between said first and second waveguide sections providing a vacuum seal without impeding propagation of microwaves along the waveguide;

a liner of dielectric material within said second waveguide section defining said discharge chamber;

means for generating a magnetic field in the discharge chamber;

means for producing a vacuum in said chamber;

means for introducing a gaseous feed material into said chamber for forming a plasma; and means for extracting an ion beam from said chamber.

* * * * *